US005622010A

United States Patent [19]

Weber

[11] Patent Number: 5,622,010

[45] Date of Patent: Apr. 22, 1997

[54] MODULAR PHARMACY

[76] Inventor: Karl F. Weber, P.O. Box 151, Moose, Wyo. 83012

[21] Appl. No.: 516,616

[22] Filed: Aug. 18, 1995

[51] Int. Cl.[6] ..... E04F 19/00

[52] U.S. Cl. ..... 52/36.4; 52/36.1; 52/79.1; 211/88; 211/94

[58] Field of Search ..... 52/36.1, 36.4, 52/79.1, 79.5; 211/88, 94, 75; 248/214, 220.21, 243, 248

[56] References Cited

U.S. PATENT DOCUMENTS

| | | | |
|---|---|---|---|
| 825,774 | 7/1906 | Stumm | 211/88 |
| 1,610,014 | 12/1926 | Koch | 211/88 X |
| 3,212,836 | 10/1965 | Johnson . | |
| 3,698,565 | 10/1972 | Weber . | |
| 4,094,416 | 6/1978 | Smith | 211/88 X |
| 4,171,596 | 10/1979 | Varlonga | 52/79.5 |
| 4,494,661 | 1/1985 | Krusche | 211/88 X |
| 4,560,072 | 12/1985 | Burrell | 211/75 |
| 4,667,579 | 5/1987 | Daw | 52/79.1 X |
| 4,881,708 | 11/1989 | Walter | 248/243 |
| 5,163,567 | 11/1992 | Betts, Sr. | 211/75 |
| 5,212,915 | 5/1993 | Antonio | 52/36.1 X |
| 5,328,137 | 7/1994 | Miller et al. | 248/220.21 |
| 5,337,525 | 8/1994 | Zaccai et al. | 52/36.4 X |
| 5,375,802 | 12/1994 | Branham, II | 211/94 X |
| 5,484,196 | 1/1996 | Kim | 248/248 X |

FOREIGN PATENT DOCUMENTS

| | | | |
|---|---|---|---|
| 2028800 | 12/1971 | Germany | 52/36.1 |
| 2252006 | 5/1973 | Germany | 52/79.5 |
| 18250 | 9/1993 | WIPO | 52/36.4 |

OTHER PUBLICATIONS

"Uniweb Systems" Brochure (Prior to Approximately 1987).

"Uniweb, A Unique Concept in Display Fixtures" Brochure (Prior to Approximately 1987).

*Primary Examiner*—Carl D. Friedman

*Assistant Examiner*—Aimee E. McTigue

[57] ABSTRACT

A panel tray display system for improving storage capabilities beyond that of standard shelving has at least one tray support panel with vertically spaced lip troughs extending substantially continuously across the panel. The display system also has trays of a standardized, modular length that is chosen to allow a user to arrange two or more trays in a substantially side-to-side relationship on the display system. Each tray has a hanger member, a tray shelf and upturned front and side retaining rails. The hanger members are engaged in lip troughs so that the trays hang from the support panel. The trays may be repositioned vertically and horizontally on the panel as desired. The predetermined modular length of the trays is shorter than the length of traditional shelving and allows the user to maximize available storage space by adjusting the vertical distances between vertically adjacent short trays. The trays are thin, on the order of 1/16 inch, to further increase available storage space. The panel tray display system may form the basis of a prefabricated product storage and dispensing facility having a modular prefabricated enclosure. The enclosure may be assembled on site from within the enclosure, so that the enclosure may be made to tightly conform to the dimensions of a space in a preexisting building.

27 Claims, 9 Drawing Sheets

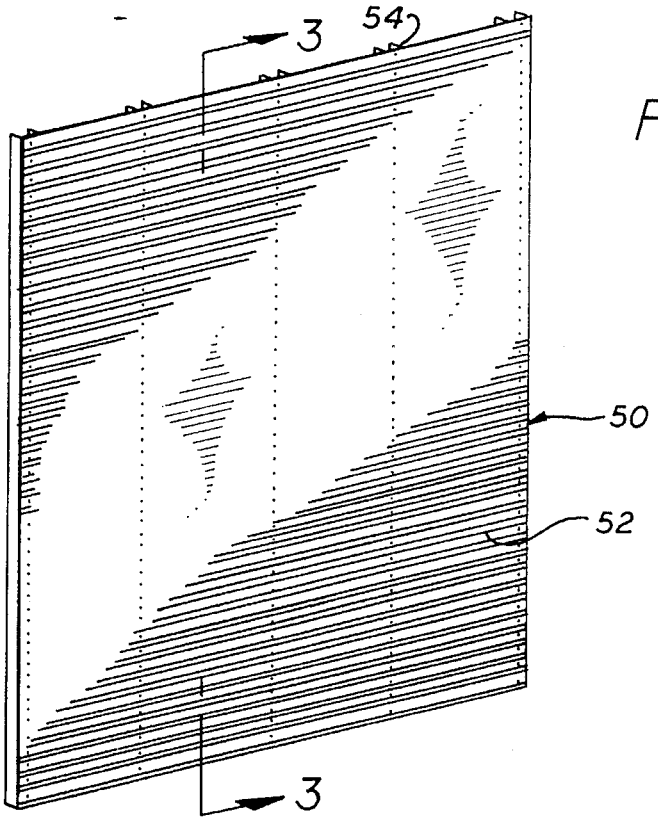
FIG. 2
FIG. 3
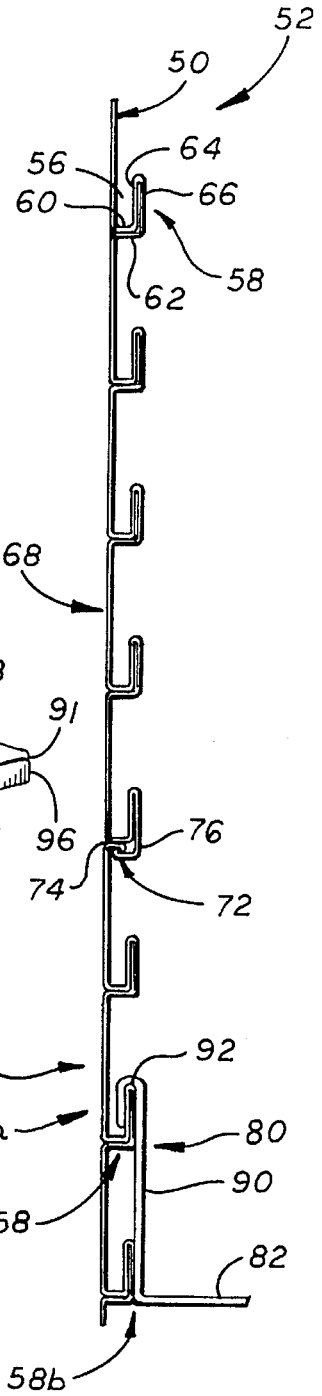
FIG. 4
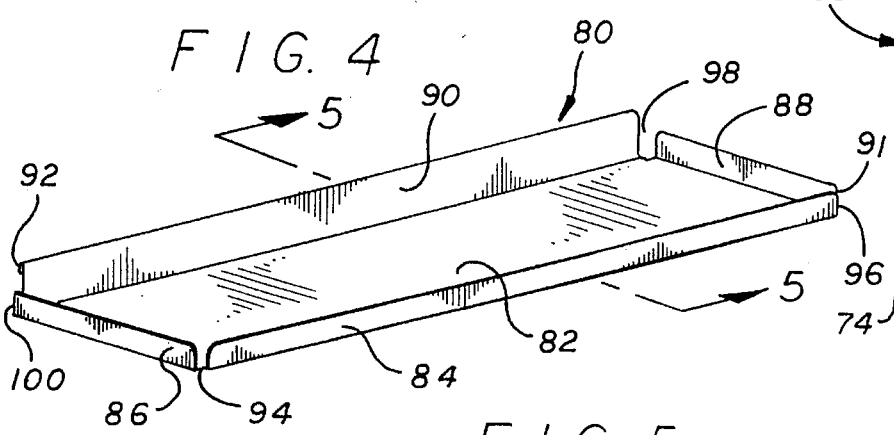
FIG. 5
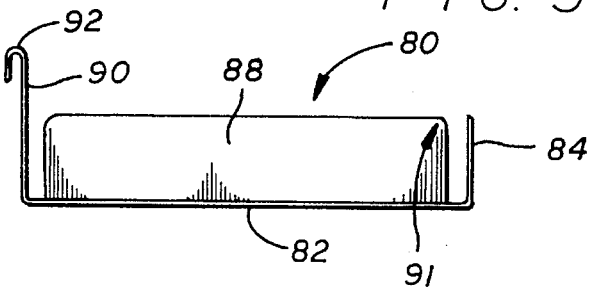

MODULAR PHARMACY

BACKGROUND OF THE INVENTION

1. Field of the Invention

The present invention relates to a panel tray display system for improving storage capabilities beyond that of standard shelving, and to a prefabricated product storage and dispensing facility incorporating such a panel tray display system.

2. Description of Prior Art

The physical plan of the pharmacy has changed little since the 1950's. Most pharmacies are an enclosed space having extensive shelving on which prescription items are stored, as well as counter space and a sink. The heart of the pharmacy is the shelving, which takes up the most space. However, as the variety of prescription products has grown and as the volume of prescription sales has multiplied, little has been done to optimize the space efficiency of traditional shelving.

There are at least four significant drawbacks with traditional pharmacy shelving. First, the width available to store and display products is less than the shelf width. The typical shelf unit has several vertically-spaced shelf boards spanning horizontally between two end boards, which prevent the products from falling off the ends of the shelf boards and provide structural stability to the shelf unit. However, the end boards are each typically ½" to ¾" thick. Consequently, for a 32 inch wide shelf unit with ¾" thick end boards, each shelf board is only 30½ inches long. That is, 1½ inches of the width of the shelf unit, or nearly 5% of the width, cannot be used to store product.

Second, the thickness of the shelves occupies what could otherwise be storage space. The shelf board in typical pharmacy shelving is between ½" and ¾" thick. For a shelf unit having ten shelves spaced eight inches apart, 5" to 7½" of vertical space is occupied by the thickness of the shelves. Another shelf could be added if this lost space could be reduced, thereby significantly increasing storage space.

Third, there is typically considerable "joint dead space" where adjacent shelf units meet, in which product cannot be stored. Most pharmacies are designed to have shelf units arranged either side-by-side or perpendicular to one another. Either way, the presence of end boards reduces the amount of available storage space.

In a side-by-side arrangement, two shelves come together at a joint. The joint is occupied by two vertical end pieces adjacent to one another. For end pieces having a thickness of ¾", 1½" inches of storage space is lost at each joint in a side-by-side arrangement.

When two or more shelf units are arranged at right angles, there is typically some "joint dead space" where the units meet that reduces storage capacity. As a practical matter, the products should be displayed so that a user can both see and reach all of the products. Unfortunately, the shelving needs end boards to prevent products from falling off of the end of the shelves. The end piece of one shelf unit typically prevents the user from seeing into and reaching into the joint to remove product from the adjacent, perpendicular unit.

Fourth, the height of the tallest package determines the vertical spacing between adjacent shelf boards. With the individual shelves spanning the full distance between end boards, the vertical spacing between the shelves is determined by the height of the tallest product on the shelf below. Although approximately 90% of all RX packaging is 6 inches high or less, the typical shelf spacing is about 9 inches to accommodate the occasional tall package. Consequently, there is often 3 inches or more of wasted empty space between the top of the typical package and the next shelf above.

This is true even with shelving in which the height between individual shelves is adjustable. RX packages are typically arranged alphabetically in a "book fashion", in which packages are arranged in ascending alphabetical order from the left hand side of a shelf to the right hand side. FIG. 1 illustrates a prior art shelving unit 40 on which RX packages 42 have been arranged in "book fashion", as books are shelved in a library.

Once a shelf is full, the alphabetical order continues at the left hand side of the next lower shelf. The tall-packages cannot be separated out onto their own shelf because to do so would be to break the alphabetical arrangement and make finding particular packages difficult. Thus, significant storage space is lost when the spacing is determined by the tallest package on the shelf below.

SUMMARY OF THE INVENTION

Broadly considered, a panel tray display system for improving storage capabilities beyond that of standard shelving has at least one tray support panel with vertically spaced lip troughs extending substantially continuously across the panel. The display system also has thin trays of a standardized, modular length that is chosen to allow a user to arrange two or more trays in a substantially side-to-side relationship on the display system. Each tray has a hanger member, a tray shelf and upturned front and side retaining rails. The hanger members are engaged in lip troughs so that the trays hang from the support panel. The trays may be repositioned vertically and horizontally on the panel as desired.

The present invention is helpful in increasing storage space as compared to typical shelving systems in a number of ways. First, the end retaining rails on each tray eliminate the need to have end boards on the shelving, thereby increasing storage space and reducing joint dead space. Second, since the trays may be thin, less vertical space is occupied by the shelving itself. Third, the modular length of each tray is typically much shorter than a traditional shelf and the vertical spacing of each tray may be adjusted independently of the next horizontally adjacent tray. Consequently, a tall package on one tray only affects the vertical spacing of the tray immediately above, rather than affecting the spacing of an entire shelf board.

Considering additional features that may be incorporated into embodiments of the present invention, the trays may have open corners to facilitate removal of dust and debris from the tray shelf. The tray shelf may relatively thin, on the order of about 1/16", to facilitate the accommodation of a greater product display area on the support panels. The end and front rails may be formed integrally with the tray shelf.

While a variety of modular tray lengths may be chosen, one optimal length for storing pharmaceuticals is approximately 16 inches long. The upper corners of the rails may be rounded for user safety.

The panel display system may have first and second panels that are arranged to form an angle of approximately 90 degrees. The first panel has an open end that is spaced a distance from the second panel to form a junction space. Because the first panel has an open end, trays mounted on the second panel may extend into the junction space, thereby replacing the joint dead space of traditional shelving with additional storage area. The end and front rails of the trays prevent products from falling off of the shelves.

Turning to additional embodiments, the system may have first and second column of vertically spaced trays, with the vertical spacing between the trays being adjustable based on the size of the packages on the trays below. The packages may be arranged in dictionary-column fashion to further maximize storage space and convenient accessibility to the packages.

Embodiments of the present invention may include additional user-convenience features. For instance, the trays generally slide side-to-side on the display panel, and lift off easily to access merchandise. The trays may have a substantially flat bottom so that a user may place the tray on a customer counter.

The panel tray display system may form the basis of a prefabricated product storage and dispensing facility having a modular prefabricated enclosure. The enclosure may be assembled on site from within the enclosure, so that the enclosure will tightly conform to the dimensions of a space in a preexisting building without demolishing any of the walls of the building. There are one or more tray support panels within the enclosure, each of the support panels having vertically spaced lip troughs. One or more trays, each having a predetermined, modular length, a tray shelf and a hanger member, hang from the display panel. A user may individually reposition the tray or trays on the display panel.

Considering one embodiment of the present invention in more detail, the prefabricated assembly may have a ceiling comprising a plurality of prefabricated structural members extending from the walls and prefabricated ceiling components suspended from the structural members above the floor. The facility may have a horizontal peripheral base channel extending about the periphery of the floor, for supporting modular floor components that extend into the horizontal peripheral base channel. The facility may also have a vertical peripheral base channel for supporting the walls.

The ceiling may have modular electric wiring, light fixtures, vents and/or other fixtures. The facility may have a sink and at least one water feed line extending to the sink. A drain line may extend from the sink, and a drain pump may pump gray water from the sink through the drain line.

Other objects, features, and advantages of the invention will become apparent from a consideration of the following detailed description and the accompanying drawings.

BRIEF DESCRIPTION OF THE DRAWINGS

FIG. 2 is a perspective view of an embodiment of a display panel according to the present invention;

FIG. 3 is a detail cross-sectional view of a display panel taken at Line 3—3 of FIG. 2 showing several lip troughs and a panel joint;

FIG. 4 is a perspective view of a display tray for mounting on the display panel of FIG. 2;

FIG. 5 is a cross-sectional view of a display tray taken about Line 5—5 of FIG. 4;

DETAILED DESCRIPTION OF THE PREFERRED EMBODIMENTS

Figure 6A:
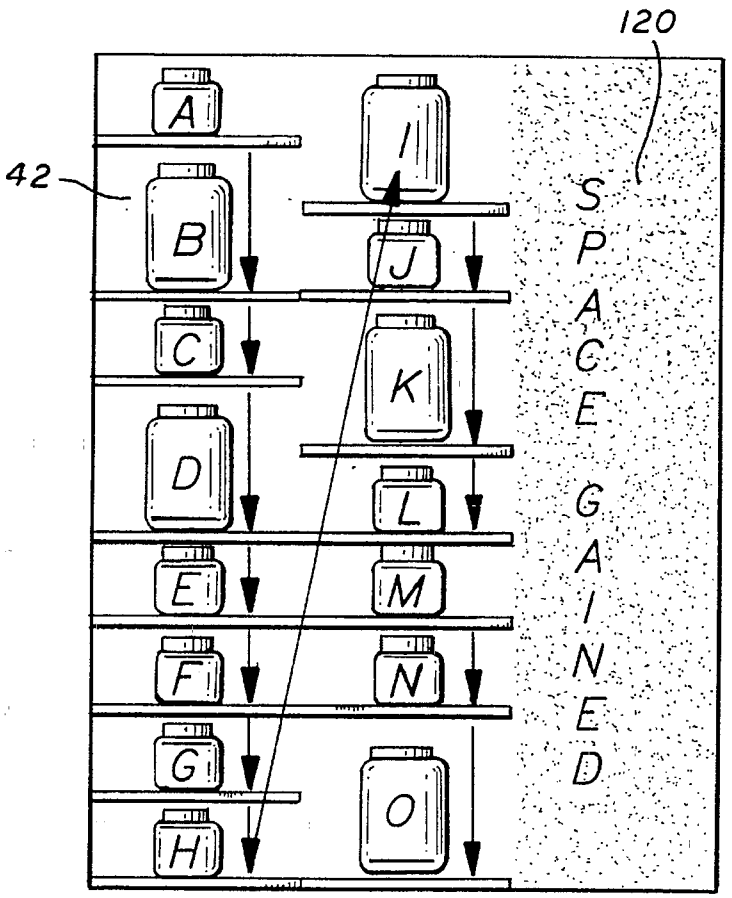
FIG. 6*a* is a front view of a display panel system in which pill bottles are arranged alphabetically in "dictionary fashion" to gain a significant amount of space over the prior art arrangement of FIG. 1.

FIG. 2 illustrates a display panel 50 having a plurality of lip troughs 52 that are vertically spaced from one another at about 1 inch. The display panel 50 is formed from sheet metal that is reinforced by vertical stiffeners 54.

FIG. 3 illustrates the lips troughs 52 of the display panel 50 in greater detail. The lip troughs 52 each have a trough 56 and an upwardly turned lip 58. The upwardly turned lip 58 has an upper rib portion 60, a lower rib portion 62, an inner flange portion 64 and an outer flange portion 66. In the exemplary panel section of FIG. 3, an upper panel section 68 is interlinked with the lower panel section 70 at the joint 72. The lower panel section 70 has a male joint member 74 that interlinks the female member 76 of the upper panel section 68. In this manner, a plurality of panel sections may be interlinked to form a support panel of desired length.

Referring to FIG. 4, a special tray 80 having a predetermined modular length may be mounted on the display panel 50 at any of the lip troughs 52. The tray 80 has a tray shelf 82, an upturned front retaining wall 84, upturned end retaining walls 86 and 88 and an upturned back retaining wall 90. The retaining walls have rounded upper corners, such as rounded corner 91. A hanger member or U-hook 92 extends from the upturned back retaining wall 90, as FIG. 5 illustrates.

Returning to FIG. 4, the tray 80 has several open corners 94, 96, 98 and 100 to allow for easy cleaning of the tray shelf 82. For example, dust that has accumulated on the tray shelf 82 may be swept by a hand broom or brush into any of the open corners, thereby allowing the user to clean the tray shelf 82 without removing the tray 80 from off of the display panel 50.

It is noted that one use for the tray 80 is to carry bottles of pills in a pharmacy. The upturned end retaining walls 86 and 88 prevent the bottles from sliding off of the ends of the tray 80. Similarly, the upturned front retaining wall 84 prevents the bottles of pills from sliding off of the front of the tray 80. It is noted that the upturned end retaining walls 86 and 88 eliminate the need to have end walls on the display panels 50. That is, in traditional shelving, there are walls on either side of the shelf case to prevent bottles of pills from sliding off.

Referring back to FIG. 3, the tray 80 is shown mounted on one of the lip troughs 52*a*. The U-hook 92 extends over the upwardly turned lip 58*a*. The back retaining wall 90 rests against the next lower upwardly turned lip 58*b* for stability. A series of trays 80 may be arranged vertically on the support panel 50 in a spaced relationship.

The particular vertical spacing between vertically adjacent trays 80 depends upon the height of the pill bottles or other packages that are stored on the tray below. For instance, if the tallest pill bottle or package on a particular tray 80 is 7 inches high, the spacing between the tray and the next higher tray must be at least 7 inches. The next higher tray may be secured to a lip trough 52 such that the spacing between the two trays is approximately 7 inches plus a small clearance space. A series of trays 80 may be vertically arranged on the support panel 50, with the vertical distance between each tray being adjusted based on the height of the packages on the tray below. This eliminates excess vertical spacing between the trays and maximizes the number of bottles or packages that can be stored on the display panel 50.

Figure 6:
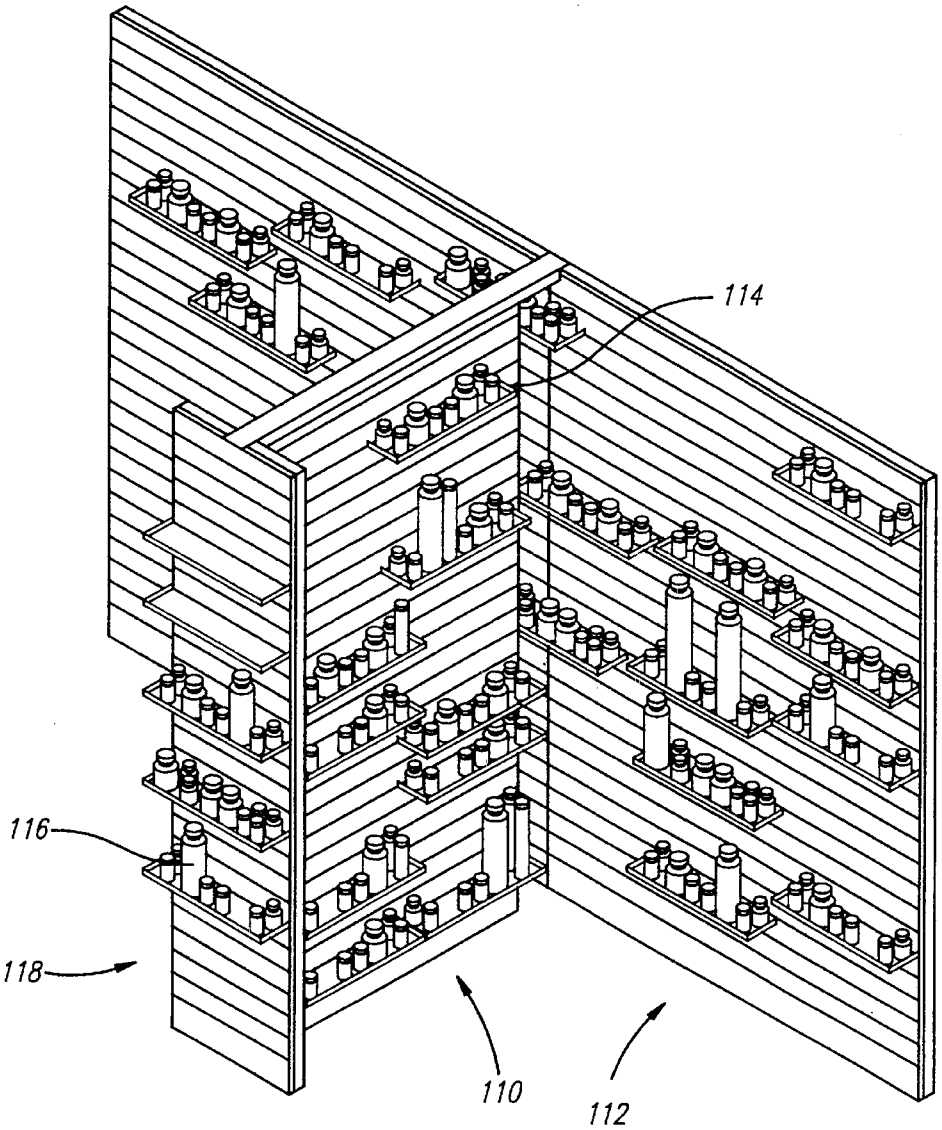
FIG. 6 is a perspective view of a display panel system having a plurality of trays arranged in a substantially side-to-side relationship, with no joint dead space at the corner formed where two perpendicular display panels meet.

FIG. 6 illustrates a number of display panels of the type illustrated in FIG. 2, arranged to form intersecting shelves. A first display panel 110 extends perpendicularly to a second display panel 112, with a substantial space 114 at the intersection of the first display panel 110 and the second shelf 112. This substantial space 114 is wide enough to allow trays mounted on the second display panel 112 to fit within the substantial space 114. No vertical end board is needed on the first display panel 110 because the trays 80 include upturned end retaining walls such as 86 and 88 of FIG. 4. These upturned and retaining walls prevent the pill bottles 116 from sliding off the end of the trays. Without such a vertical end board, a user may easily reach into the space at the intersection area 114 to reach a tray extending therein from the shelf 112. This arrangement eliminates the joint dead space that is typically found in prior art arrangements.

FIG. 6 also illustrates a plurality of trays arranged in a substantially side-to-side arrangement on the first display panel 110. The vertical spacing between vertically adjacent trays varies from tray pair to tray pair, depending upon the height of the tallest bottle on the tray below. In FIG. 6, there are two separate vertical columns of trays on panel 110 and three columns on panel 112. More columns could be made if shorter trays were employed.

A third display panel 118 crosses the front of the first display panel 110 to add additional storage space for the pill bottles 116.

Figure 1:
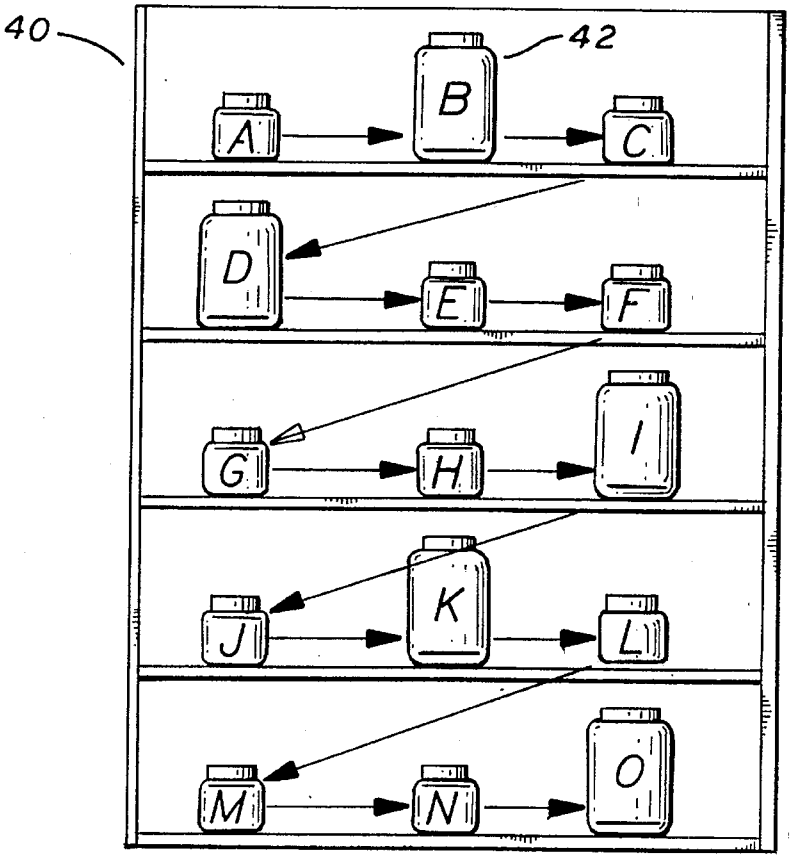
FIG. 1 is a front view of a conventional shelving unit in which RX packages are set alphabetically in "book fashion"

FIG. 6*a* illustrates how a user may utilize the display panel system of FIG. 6 to alphabetically arrange a number of pill bottles 42 in a "dictionary fashion". Each of the relatively short, modular-length trays is vertically spaced to just clear the bottle on the tray below. Consequently, the occasional tall bottle affects the vertical spacing of only one relatively short tray, rather than the spacing of an entire shelf, as the prior art arrangement of FIG. 1 would require. Thus, the present display panel system results in significant gained space 120 as compared to the conventional shelving of FIG. 1.

Figure 7:
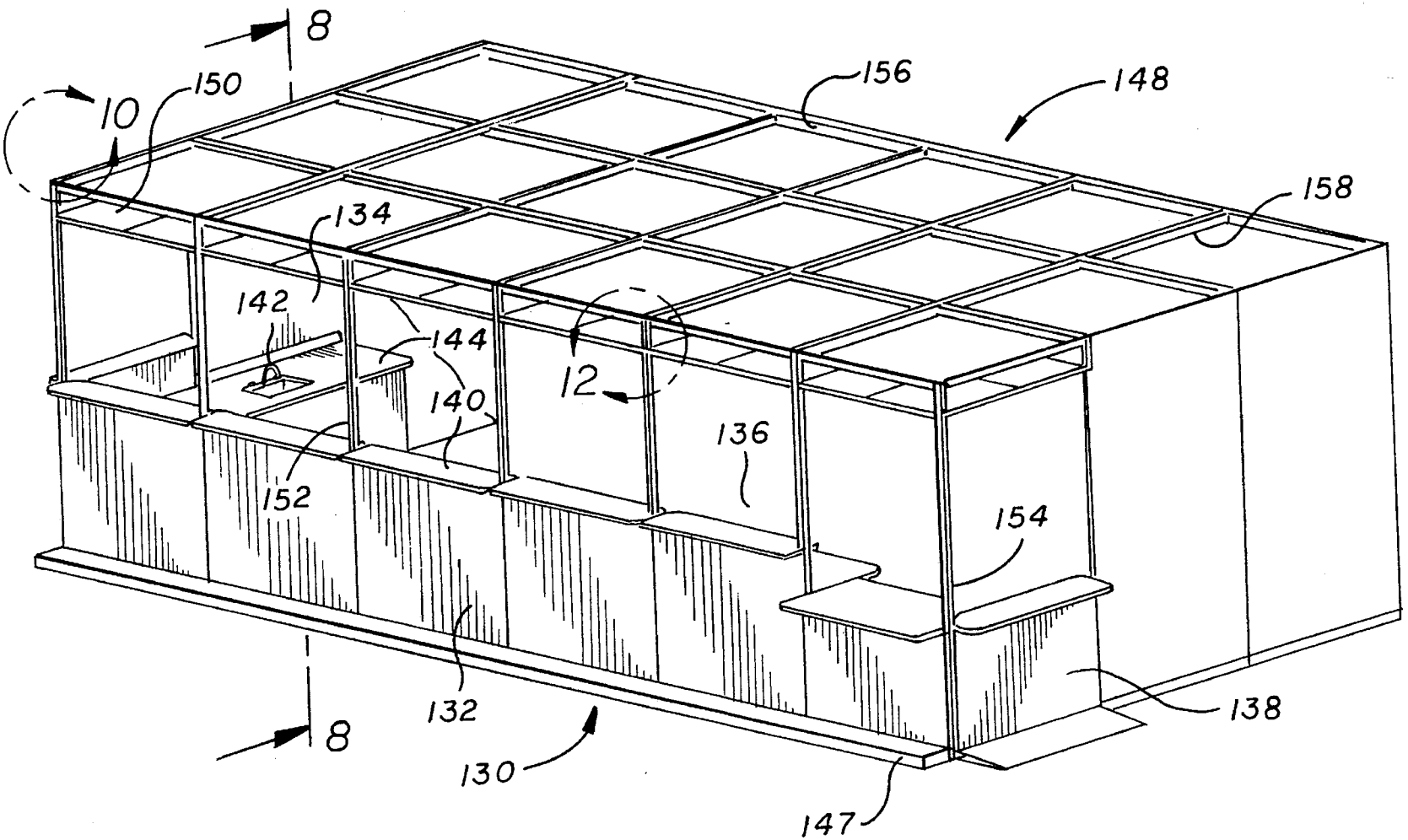
FIG. 7 is an exterior perspective view of a prefabricated product storage and dispensing facility having lip trough display panels optionally on some of the interior surfaces of the walls and on some of the exterior surfaces of the walls.

The display panels 50 may be used to form the walls of a highly space efficient modular, prefabricated storage and distribution facility, such as the facility 130 of FIG. 7. Display panels form the outer surface 132 of the outer walls, as well as the interior surface of the outer walls. The display panels are bolted at the base onto a base plate to hold the panels in place.

The facility 130 also includes a variety of display panels arranged on the interior, such as the arrangement illustrated in FIG. 6. The prefabricated facility 130 has windows or openings 136, an entrance/exit door 138 and a variety of external counters 140. The facility 130 may also have an interior sink 142 having a counter 144.

The facility 130 has a modular, raised floor 146 and a modular ceiling 148. The modular ceiling 148 may have a plurality of hung ceiling tiles 150. Structurally, the facility 130 has a number of center columns 152 and corner columns 154 extending vertically from the floor 146. The ceiling has a variety of perimeter beams 156 extending about the perimeter of the ceiling. Ceiling joists 158 extend in a criss-cross pattern across the length and width of the ceiling 148, extending from joints at the perimeter beams 156.

The modular system 130 goes into existing stores, and can be constructed from the inside out such that is may be erected in relatively tight spaces. For instance, the modular pharmacy unit may be installed directly against three existing walls (e.g., at the back and two sides of the pharmacy). The modular design of the pharmacy unit allows a construction crew to erect the unit from the inside, without having to demolish any of the pre-existing walls.

Figure 8:
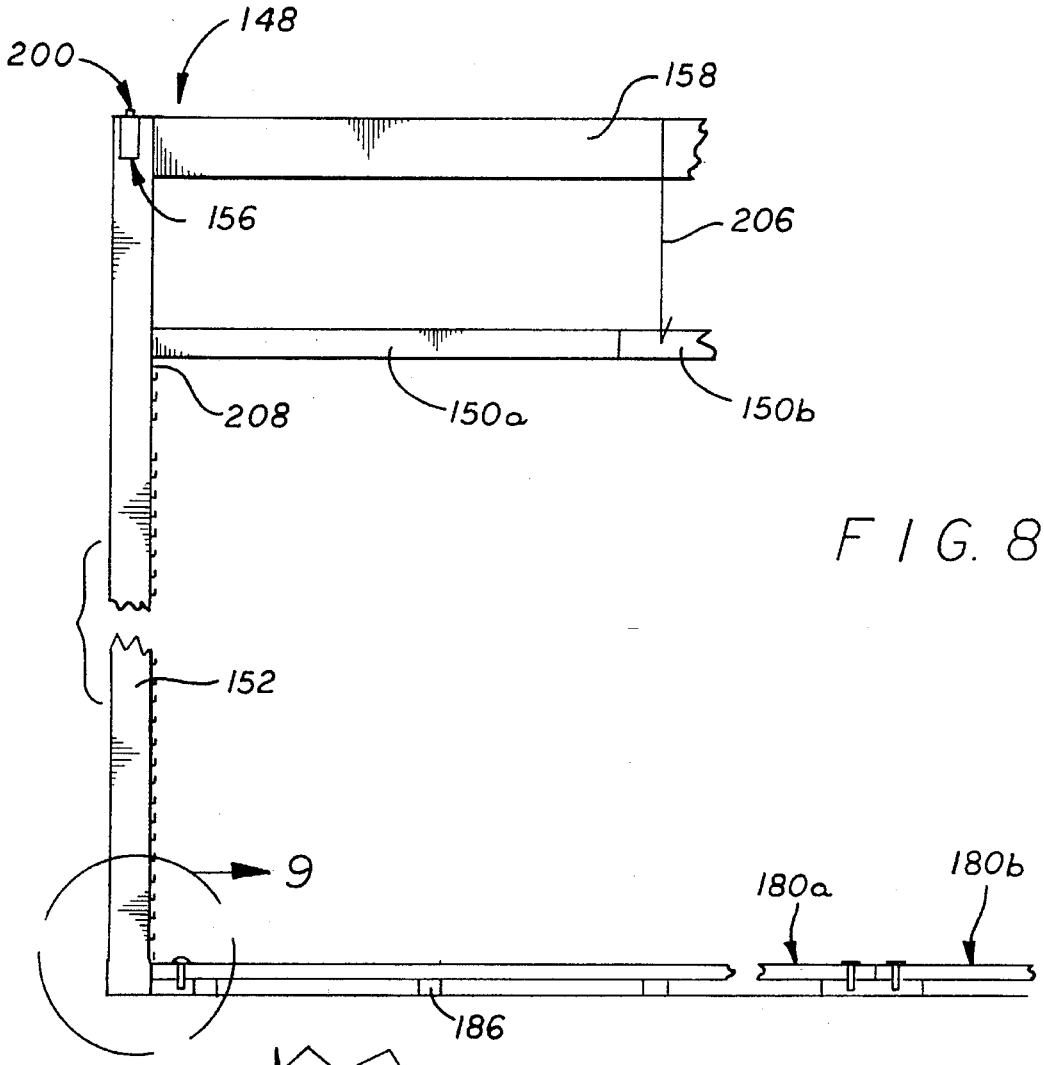
FIG. 8 is a cross-sectional view of the prefabricated assembly of FIG. 7 showing the floor and ceiling construction.
Figure 9:
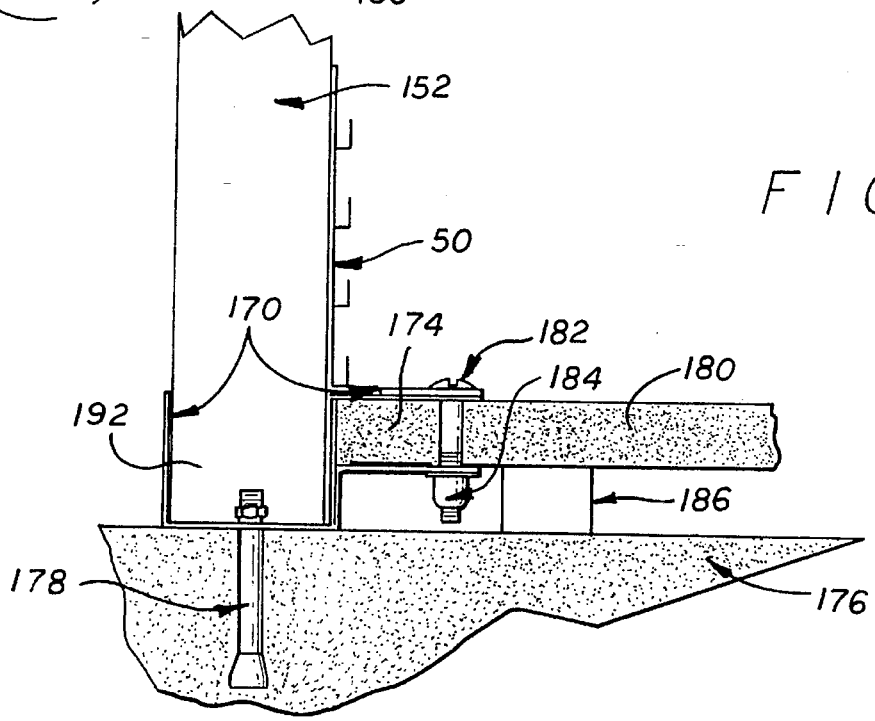
FIG. 9 is a detail view of the floor construction taken at Section 9 of FIG. 8.

The structure of the modular facility 130 is illustrated in more detail in FIGS. 8 and 9. A base channel 170 extends about the bottom perimeter of the storage and distribution facility 130. The base channel 170 has a vertical channel component 172 and a horizontal channel component 174. The base channel 170 is anchored into the concrete slab 176 with anchor bolt and nut 178.

The center columns 152 extend down into the vertical component 172 of the base channel 170. The modular floor panels 180 extend into the horizontal component 174 of base channel 170, and are held in place by cap bolts 182 and associated weld nuts 184. A 16 guage pressure plate is welded onto the bottom of the channel at the corners. The corners are mitered so that the channels do not need to be directly welded together. The pressure plate maintains the corners at 90 degree angles.

Considering the center columns 152, these are typically 2 inch square tubing display panels 50 may be mounted on the interior and/or exterior of the center columns 152 and on the center columns 154.

The ceiling 148 includes ceiling tiles such as 150*a* adjacent to the center column 152 and ceiling tiles 150*b* which are interior to the perimeter ceiling tiles 150*a*. The perimeter ceiling tiles 150*a* are supported at the center columns 152 by a ceiling bracket 208. The ceiling tiles 150*b* are supported from the ceiling joists 158 by heavy duty ceiling hooks 206. The perimeter ceiling tiles 150*a* may also be supported by heavy duty ceiling hooks such as 206.

The modular floor panels 180 are arranged to form the floor of the module. For example, in FIG. 8, a first floor panel 180*a* is bolted into the horizontal channel 174 at one edge of the assembly. A second floor panel 180*b* is situated adjacent to the first floor panel 180*a*. Both panel 180*a* and panel 180*b* are bolted or nailed to a common anchor board 181. Additional floor panels may be added in front of, behind, and/or to the side of panels 180*a* and 180*b* in order to make the floor as wide and deep as desired.

The 20-guage stiffeners 186 reinforce the floor panels 180*a* and 180*b*, although the stiffeners are spaced far enough from one another to allow the floor to flex somewhat under the weight of a person walking on the floor. Most users find the flexible floor to be easier on the legs than walking on a fully rigid surface such as concrete.

Figure 12:
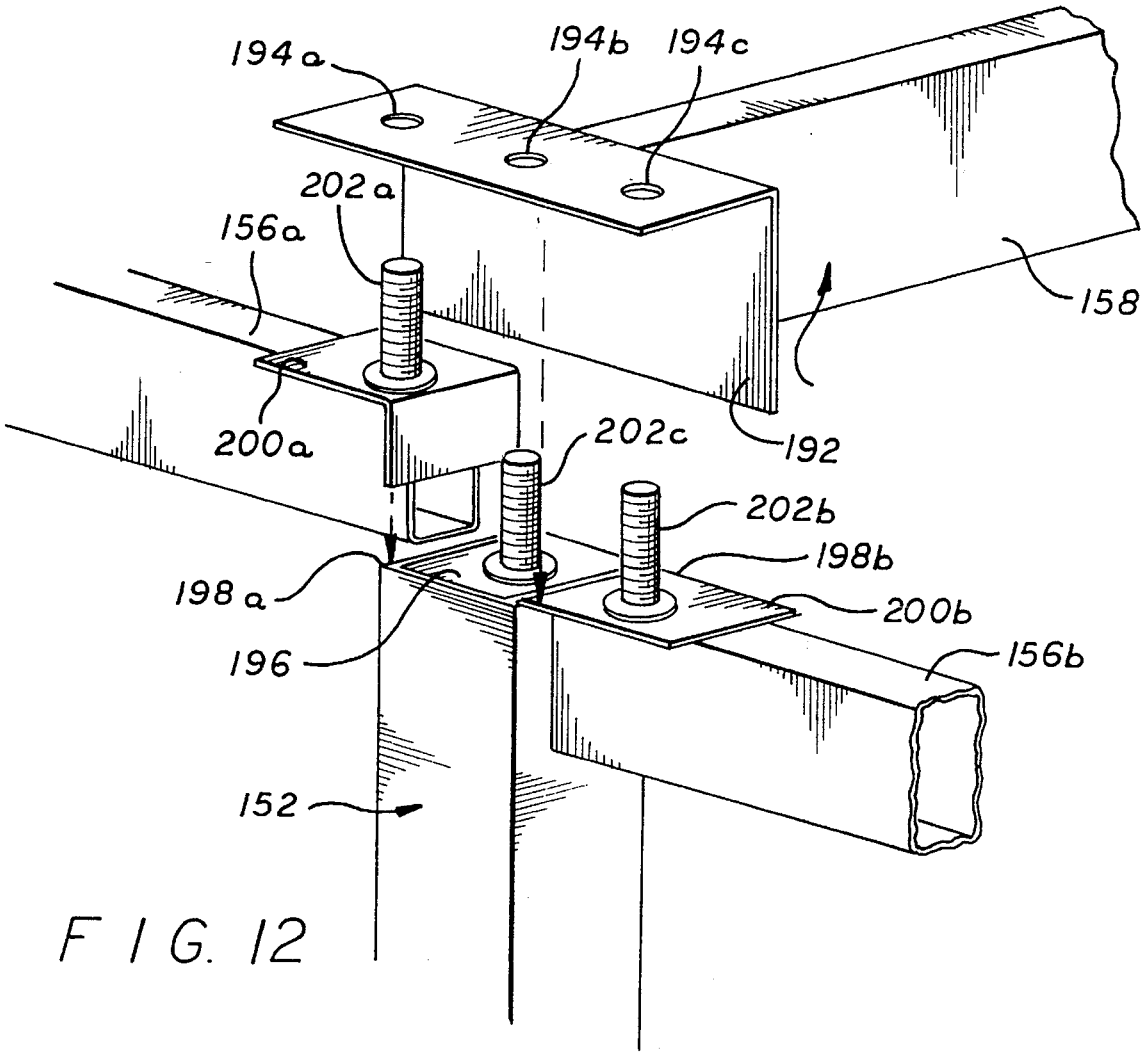
FIG. 12 is an exploded perspective view of the ceiling joint at Section 12 of FIG. 7.

The center columns 152 extend upwardly from the floor to respective ceiling joists 158 and to the respective perimeter beams 156. FIG. 12 is a detailed illustration of the center column intersection of Section 12 (FIG. 7). The ceiling joist 158 has an angle member 192 welded to the end thereof. The angle member has three apertures 194*a*, 194*b* and 194*c* therein.

A plate 196 is welded onto the top of the center column 152. The plate 196 is not quite as wide as the open top of the center column, thereby leaving the slots 198*a* and 198*b* on either side of the plate 196. Hang angles 200*a,b* are mounted on the ends of the perimeter beams 156*a,b*, and the downturned portion of each hang angle slides into a respective slot 198*a,b* to interconnect the perimeter beams with the center column.

The plate 196 and the hang angles 200*a,b* each have a weld stud 202*a,b,c* welded thereto. To fixedly interconnect the center column 152, the perimeter beams 156*a,b* and the ceiling joist 158, the angle member 192 is lowered from the position of FIG. 12 so that the weld studs 198*a,b,c* pass through the holes 194*a,b,c*. The angle member 192 is then bolted onto the upper surface of the hang angles 200*a,b* and the plate 196.

Figure 10:
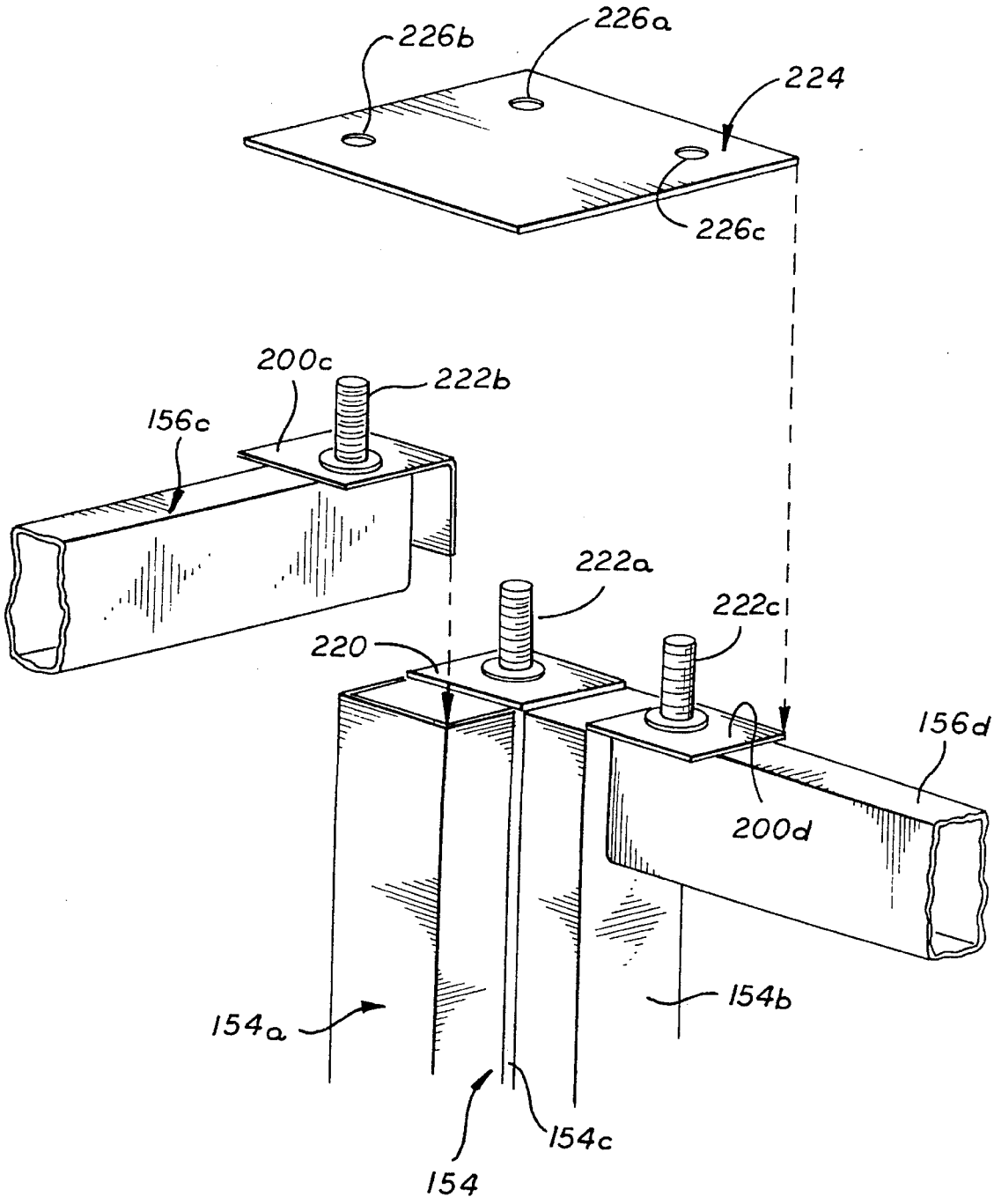
FIG. 10 is an exploded perspective view of the corner at Section 10 of FIG. 7.
Figure 11:
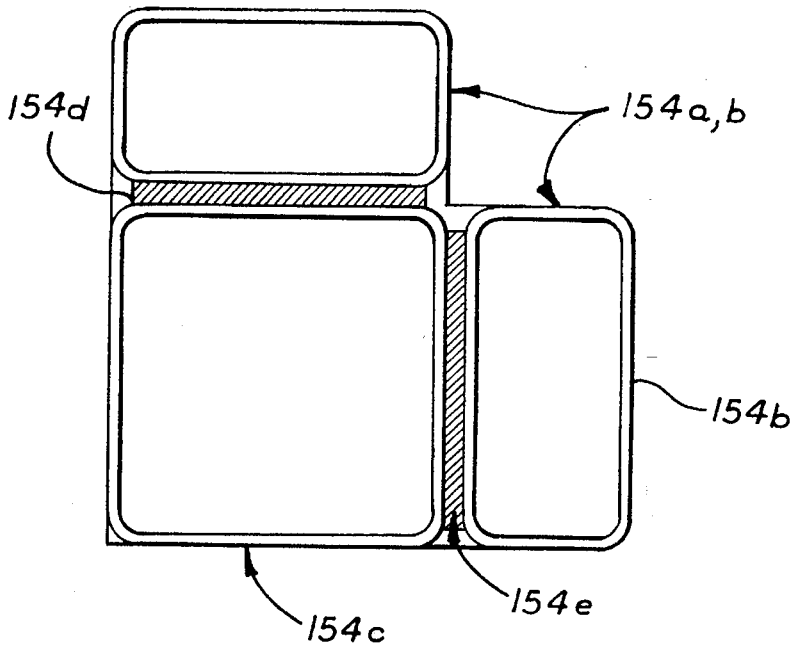
FIG. 11 is a sectional view of the corner column of FIG. 10.

FIG. 10 illustrates the corner of Section 10 of FIG. 7 in greater detail. The corner column 154 extends from the base channel 170 vertically up to the ceiling 148. The corner column 154 has a first outer tube 154*a*, a second outer tube 154*b* and a central tube 154*c*. The central tube 154*c* is separated from first corner tube 154*a* and second corner tube 154*b* by steel spacers 155*a* and 155*b*, respectively (FIG. 11).

The perimeter beams 156*c,d* include respective hang angles 200*c,d* at the ends thereof. The downturned portions of the hang angles 200*c,d* insert into corner tubes 154*a,b* to interconnect the perimeter beams with the corner column.

A plate 220 is welded to the top of the central tube 154*c*. Weld studs 222*a,b,c* are welded to the upper surfaces of the plate 220 and the hang angles 200*c,d*. A pressure plate 224 having holes 226*a,b,c* is lowered from the position of FIG. 10 such that the weld studs 222*a,b,c* protrude from the respective holes 226*a,b,c*. The pressure plate is then bolted onto the hang angles and plate to fixedly interconnect the perimeter beams 156*c,d* to the center column.

Figure 13:
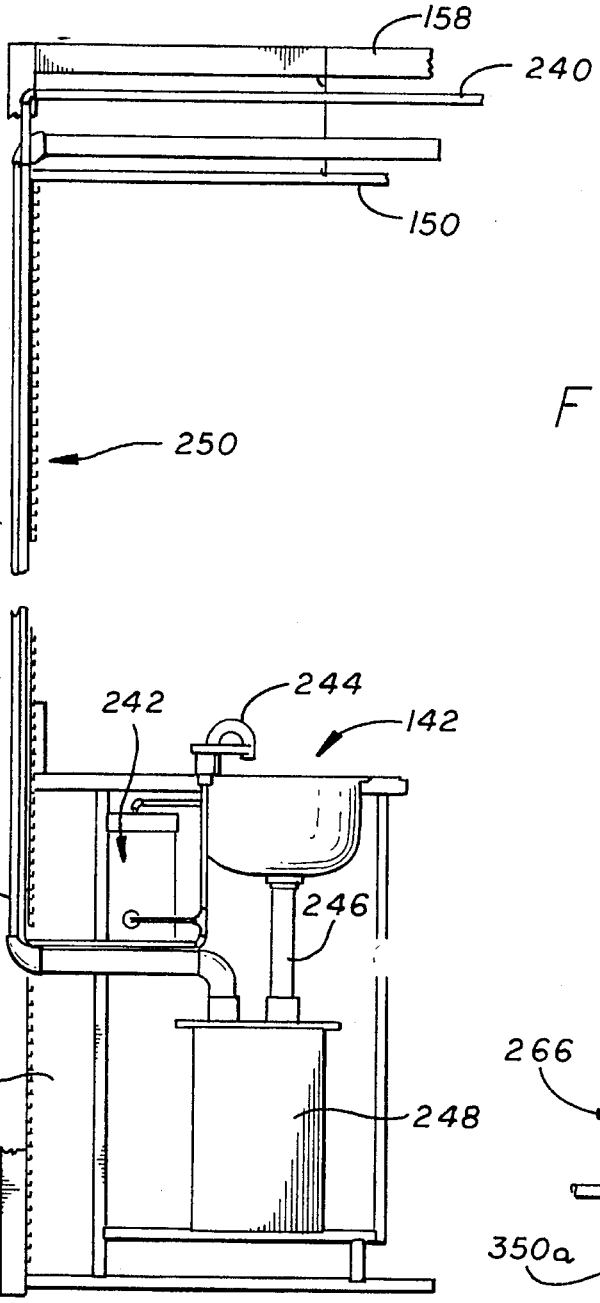
FIG. 13 is a sectional view of a sink and plumbing construction, with the sink being adjacent to an exterior wall of the prefabricated assembly.

The prefabricated storage and distribution facility 130 may have one or more sink units 142. FIG. 13 is a cross section taken vertically at sink 142 in FIG. 7. The prefabricated storage and distribution facility 130 has a cold water feed pipe 240 running along the ceiling, in between the ceiling joists 158 and the ceiling tiles 150, then down along the exterior of an outer wall until reentering the facility 130 at the sink 142. Some of the cold water flowing through the cold water feed 240 may flow into the water heater 242 before proceeding to the faucet 244. The user may then select cold water or hot water or a mixture of the two as desired by turning the control knobs on the sink.

A drain pipe 246 extends vertically down from the sink 142 into a gray water pump 248. The gray water pump 248 then pumps the gray water running from the sink 142 up through a gray water exit pipe 249. The gray water exit pipe may be fitted with a coupling for easy interconnection with the existing plumbing of a surrounding structure.

A lip trough display panel 50*a* may extend vertically behind the sink 142. Consequently, a user may store a variety of packages immediately above the sink by mounting trays such as tray 80 of FIG. 4 on the display panel 250.

An open space 252 between the sink 142 and the panel wall may be provided through which to run electrical wiring for the water heater 242, and for an electrical outlet to be provided adjacent to the sink 142. It is noted that the cold water feed pipe 240 and the gray water exit pipe 248 may be supported by heavy duty ceiling hooks that are somewhat heavier than those which support the ceiling tiles 150.

Figure 14:
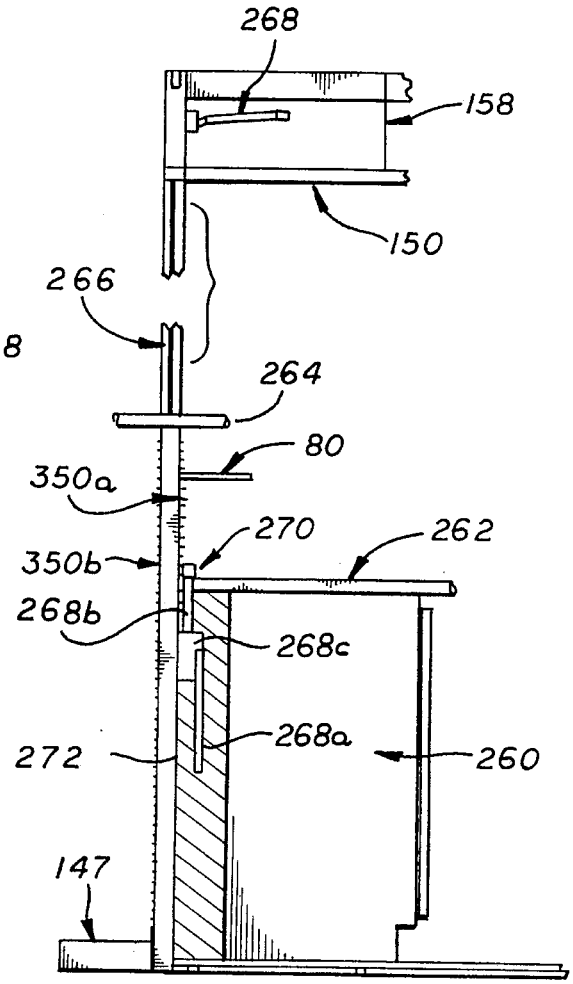
FIG. 14 is a sectional view of a cabinet, with the cabinet being adjacent to an exterior wall of the prefabricated assembly.

Referring to FIG. 14, the prefabricated storage and distribution facility 130 may include one or more cabinets 260 having counter tops 262 and 264 for work space. Counter tops 264 extend both on the interior and the exterior of the storage and distribution facility 130. The counter tops may optionally have a laminate surface, and may have molding on one or more of the sides.

A lip trough display panel 350*a* may extend immediately above the counter top 262 such that the trays 80 may extend above the counter top 262. Another display panel 350*b* may extend behind the cabinet 260 on the exterior of the storage and distribution facility 130. A glass window 266 may extend above the counter top 264 up to the hung ceiling tile 150.

Conduits from a modular wiring system 268 may extend between the ceiling tiles 150 and the ceiling joists 158, and down to a power strip 270 mounted adjacent to the counter top 262. A void 272 behind the cabinet 260 provides space for modular wiring system conduits 268*a* and 268*b*, along with a modular wiring system junction box 268*c*.

Use of the modular wiring system further reduces the time required to install the modular pharmacy. The modular wiring system includes various pre-fabricated components, including wiring of modular length and snap connectors for interconnecting the wiring. The modular nature of the system provides simple installation with maximum design flexibility to meet the needs of a particular pharmacy configuration.

Openings may be provided in the vertical columns, so that flexible tubes bearing the electrical wiring and/or telephone or other wiring may run through the interior of the column. This both protects the flexible wiring and provides the modular pharmacy with a tidy appearance.

One type of modular wiring system is available from the Metalux Lighting Division of the Cooper Lighting Company in Americus, Georgia. The system is U.L. approved and is safe for use in a modular pharmacy constructed within a preexisting structure. The modular wiring system is hard wired into the existing electrical wiring of the structure, and is generally very easy to install.

Figure 15:
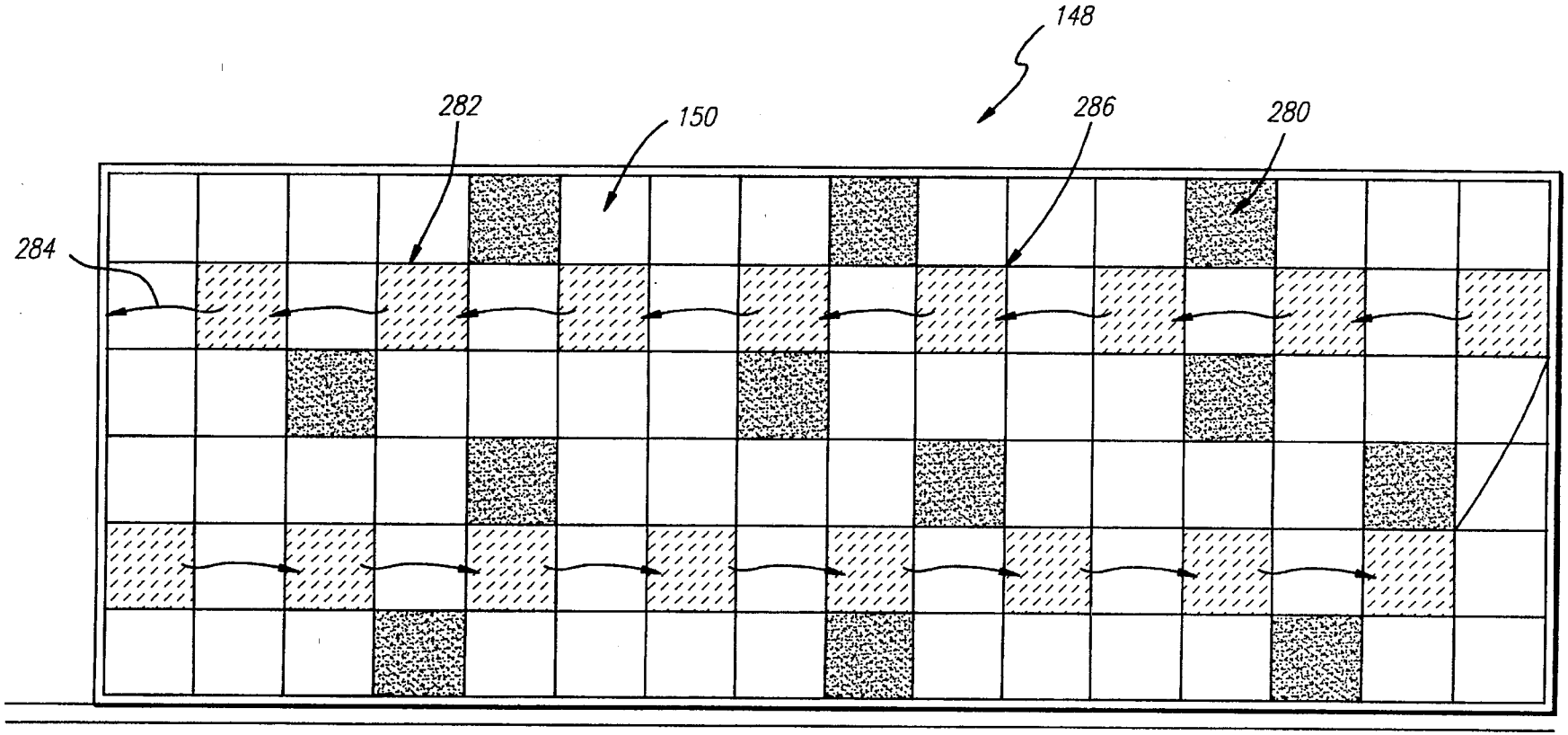
FIG. 15 is a plan view looking down onto the ceiling and showing the modular wiring system, lights and vents.

Focusing now on the ceiling 148, FIG. 15 is a top view showing various ceiling tiles 150, various vents 280 for air conditioning, heating and/or ventilation, and assorted light fixtures 282. It may be noted that the ceiling 148 is of the "T-bar" type and is suspended by the heavy duty ceiling hooks 206. The light fixtures 282 are electrically connected with the modular wiring system conduits 284. The ceiling 148 is framed with perimeter beams 156. However, the ceiling joists 158, as seen in FIG. 7, are deleted in FIG. 15 for clarity.

It should be noted that the ceiling tiles are not directly connected to the heavy duty ceiling hooks. Rather, a criss-cross pattern of metal frame members 286, each having a horizontal channel, extends from the center columns of the facility structure. The heavy duty ceiling hooks attach at or near joints of this criss cross structure. The horizontal channels of the criss-cross frame members support the ceiling tiles, lighting fixtures and vents.

An important aspect of a presently preferred embodiment of the invention is that the pharmacy may be assembled on site from within. For example, the pharmacy can be constructed from within a space enclosed by three existing permanent walls without having to demolish any of the existing walls. As many as three sides of the pharmacy may be up against permanent walls, so that the enclosure will tightly conform to the dimensions the space. This aspect of the present invention is a significant improvement over previous methods of pharmacy construction, which require demolition of existing permanent walls and make pharmacy construction expensive, time consuming and inconvenient.

Exemplary Materials and Dimensions

The following materials and dimensions are given as examples only, and should not be construed as limitations.

The display panels 50 are typically 48 inches wide by 96 inches high. The lip troughs 52 are typically spaced one inch apart, such that the distance from one lower rib portion 62 to the lower rib portion of the immediately adjacent next lip trough is one inch. The upwardly lips 58 are typically 0.375 inch high and 0.048 inch wide, and the upper rib portion 60 is typically 0.120 inch wide. The support panel 50 is typically formed from 24 guage cold rolled steel.

The vertical stiffeners 54 are typically 1⅛ inches deep and are spaced approximately 12 inches from one another. The stiffeners 54 are typically 1³⁄₁₆ inches wide, and may be inset up to 1⅝ inches from the edge of the display panels 50.

The display trays 80 are typically 16 inches long by 7.29 or 6.0 inches wide. The back retaining wall 90 is typically 1.5 inches high, with the U-hook portion 92 extending downwardly a distance of approximately 0.40 inch. The tray shelf 82 is generally set at an 86° angle from the back retaining wall 90, in order to prevent the product from sliding forward on the tray. The upturned front retaining wall 84 and the end retaining walls 86 and 88 are typically 0.63 inch high. The upper corners of the front retaining wall 84 and the end retaining walls 86 and 88 are typically rounded so as to protect the user from contact from sharp corners.

The counter tops 262 and 264 may be 30 or 48 inches and 12 inches wide, respectively, and may be 1³⁄₁₆ inch thick. The cabinet 260 may be 38 inches tall, 23 inches deep, and the void 272 behind the cabinet may be 5 inches deep. The counter top 264 may be 53¾ inches high, as measured from the base.

The hanging ceiling tiles 150 may be 109½ inches high as measured from the base. The ceiling joists 158 may be 120 inches high, as measured from the concrete floor. The counter top 264 may be 16 inches above the counter top 262.

The center column 152 may be 2 inch square metal tubing. The first and second corner tubes **154*a* and 154*b* may be 1 inch×2 inch steel tubing, separated from the 2 inch×2 inch steel tubing of the central tube 154*c* by ⅛ inch thick by 120 inch long steel spacers 154*d* and 154*e*. The mounting plate 220 may be made of 16 guage steel. The pressure plate 224** may be made of 14 guage steel.

The floor stiffeners 186 may be 20 gauge steel and may be spaced approximately 14¼ inches apart. The modular floor panels may be 4 feet×12 feet by ¾ inch thick. Since the modular floor panels are 4 feet wide, the width of a particular storage and dispensing facility may be customized in increments of 4 feet.

The ceiling tiles are typically 2 feet×2 feet. The florescent lights are also typically 2 feet×2 feet, as are the air conditioning grills and vents. The interior height is typically about 9 feet. The low fatigue, low profile raised floor typically has a maximum height of 2¼ inches.

It is estimated that the present storage and dispensing facility, when used as a modular pharmacy, can provide 45 percent more shelf space than typical pharmacy shelving units, and require 30 percent less fixturing. Additionally, since there is no joint "dead-space", storage space is not lost at the ends of the shelves. Sixteen (16) inch length trays replace the normal 30, 32 or 36 inch shelves in the typical prior art pharmacy. This allows the flexible use of 24 16-inch trays that are spaced 5.6 inches above each other versus the current use of full length shelves, 9 shelves per bay with 8 inches between them. With 90 percent of all Rx packaging being 6 inches in height or below, the present system allows for much greater space utilization.

In conclusion, it is to be understood that the foregoing detailed description and the accompanying drawings illustrate the preferred environments of the invention. However, various changes and modifications may be made without departing from the spirit and scope of the invention. Accordingly, the present invention is not limited to the embodiments shown in the drawings or described in detail hereinabove.

What is claimed is:

1. A pharmacy panel tray display system for improving storage capabilities beyond that of standard shelving in which shelves span continuously between end wall supports, the display system comprising:

a plurality of trays for storage and display of pharmaceutical products having a substantially flat bottom, a modular length of between approximately 12 and 20 inches, and a height, said modular length being chosen for allowing a plurality of trays to be arranged in a substantially side-to-side relationship on the display system, said height being chosen for allowing vertically adjacent trays to be closely spaced on the display system;

each tray comprising a hanger member, a tray shelf having a back retaining wall, a front, a first end and a second end, an upturned front retaining rail at the front of said tray shelf, a first upturned end retaining rail at the first end of said tray shelf and a second upturned end retaining rail at the second end of said tray shelf, with said back retaining wall being taller than said retaining rails; and at least one tray support panel having a plurality of vertically spaced lip troughs that are vertically spaced at intervals of approximately one inch, each lip trough extending substantially continuously across said panel;

said trays being generally arranged in columns on said display, the vertical position of each tray being independent of the vertical position of a corresponding tray in an adjacent column;

wherein each hanger member is engaged in at least one of said lip troughs such that said support panel supports said trays, with said trays being easily removable from said lip troughs, and wherein said trays may be repositioned vertically and slid horizontally on said tray support panel and wherein, when products are stored on the trays, the vertical spacing of the trays within each of said columns is generally as close as the height of the products and the vertical spacing of the lip troughs permit, to minimize empty space on the display system.

2. A panel tray display system as defined in claim 1, wherein said front retaining rail is separated from said first end retaining rail by a first gap and said front retaining rail is separated from said second end retaining rail by a second gap, wherein said first and second gaps facilitate removal of dust and debris from said tray shelf.

3. A panel tray display system as defined in claim 1, wherein said tray shelf is relatively thin, on the order of about 1/16 inch, to facilitate the accommodation of a greater product display area on said at least one support panel.

4. A panel tray display system as defined in claim 1, wherein said end and front rails are formed integrally with said tray shelf.

5. A panel tray display system as defined in claim 1, wherein said system comprises a plurality of panels and wherein a first panel and a second panel are arranged to form an angle, said first panel having an open end that is spaced a distance from said second panel to form a junction space, with one or more of said trays being connected to said second panel and extending into said junction space.

6. A panel tray display system as defined in claim 1, wherein said system comprises at least a first and a second column of vertically spaced trays, the vertical spacing between adjacent trays within each column being adjustable.

7. A panel tray display system as defined in claim 6, wherein said system further comprises a plurality of labelled containers, said containers being arranged alphabetically from top to bottom within each of said columns in a substantially dictionary fashion, wherein the vertical spacing between vertically adjacent trays is adjusted to correspond to the height of the particular containers on each tray, thereby increasing storage capacity as compared to traditional shelving having a plurality of continuous shelves that extend between two end walls.

8. A panel tray display system as defined in claim 1, wherein each of said one or more trays is approximately 16 inches long.

9. A panel tray display system as defined in claim 1, wherein each of said rails has upper corners, said upper corners being rounded to protect a user against injury from impact against a sharp corner.

10. A highly space-efficient prefabricated product dispensing and storing facility comprising:

a modular, expandable prefabricated enclosure assembled at a site comprising a floor made up of a plurality of prefabricated components, one or more walls comprising a plurality of prefabricated frame members that extend vertically about the periphery of said floor, and a ceiling;

one or more tray support panels within said enclosure, each of said support panels having a plurality of lip troughs that extend across the width of the panel and that are vertically closely spaced to one another;

said walls comprising at least one of said tray support panels;

one or more substantially flat-bottomed, light weight, thin-walled trays having a modular length of between approximately 12 and 20 inches, said modular length being chosen for allowing a plurality of trays to be arranged in a substantially side-to-side relationship on at least some of said support panels, each of said trays comprising a tray shelf having a back retaining wall, a front, a first end and a second end, an upturned front retaining rail at the front of said tray shelf, a first upturned end retaining rail at the first end of said tray shelf and a second upturned end retaining rail at the second end of said tray shelf, with said back retaining wall being taller than said retaining rails and a hanger member connected to said tray shelf; and said upturned retaining rails preventing products from sliding off the tray;

wherein said support panel supports a tray when said hanger member is engaged in one of said lip troughs, and wherein the short, modular length of said trays allows the trays to be individually repositioned vertically and slid horizontally along the lip troughs to minimize empty space on the support panels.

11. A prefabricated product storage and dispensing facility as defined in claim 10, wherein:

said facility further comprises a horizontal peripheral base channel extending about the periphery of said floor; and at least some of said floor components extend into and are supported by said horizontal peripheral base channel.

12. A prefabricated product storage and dispensing facility as defined in claim 10, wherein said facility further has at least one outer wall comprising at least one of said tray support panels such that one or more of said trays may be mounted on the exterior of said facility.

13. A prefabricated product storage and dispensing facility as defined in claim 12, wherein said outer wall has an inner surface facing inwardly into said facility, said inner surface comprising at least one of said tray support panels.

14. A prefabricated product storage and dispensing facility as defined in claim 10, wherein said ceiling components comprise ceiling tiles and a criss-cross support frame, and wherein said ceiling further comprises a plurality of heavy duty ceiling hooks hanging from said structural members, said ceiling hooks supporting said support frame, said ceiling tiles being engaged in said support frame.

15. A prefabricated product storage and dispensing facility as defined in claim 10, wherein said ceiling further comprises electric wiring, light fixtures, and vents.

16. A prefabricated product storage and dispensing facility as defined in claim 10, wherein said facility further comprises a sink and at least one water feed line extending to said sink.

17. A prefabricated product storage and dispensing facility as defined in claim 16, wherein said facility further comprises a drain line extending from said sink and a drain pump for pumping gray water from said sink through said drain line.

18. A prefabricated product storage and dispensing facility as defined in claim 10, wherein said facility conforms tightly to a space having predefined dimensions, and wherein said facility may be assembled from within the space.

19. A method of storing and dispensing pharmacy products comprising the steps of:

preparing a prefabricated product storage and dispensing facility as defined in claim 10, said facility being a prefabricated pharmacy;

placing packages of various heights on the trays;

placing the trays in adjacent columns on a support panel; and vertically positioning the trays on lip troughs within each column such that the bottom of one tray is just a short distance above the tallest package on the tray below, with the vertical position of one tray in one column being independent of the vertical position of a corresponding tray in an adjacent column, such that the trays within each column have close vertical spacing to minimize empty space on the support panel.

20. A method of storing and dispensing pharmacy products as defined in claim 19, wherein the packages are labeled containers and wherein the method further comprises the step of arranging the containers alphabetically from top to bottom within each of said columns in a substantially dictionary fashion.

21. A method of storing and dispensing pharmacy products as defined in claim 19, wherein the step of preparing a prefabricated product storage and dispensing facility includes arranging a first support panel at an approximately 90 degree angle to a second support panel, with a space in between the first and second support panels, and wherein the method further includes mounting one of said trays to said second support panel, such that the tray extends into the space, thereby turning what would be "dead space" in conventional shelving systems into usable storage space.

22. A highly space-efficient prefabricated product storage and dispensing facility comprising:

a modular prefabricated enclosure assemblable at a site from within the enclosure;

one or more tray support panels within said enclosure, each of said support panels having a plurality of vertically spaced lip troughs; and one or more trays, each having a predetermined, modular length of between 12 and 20 inches and comprising a tray shelf having a back retaining wall, a front, a first end and a second end, an upturned front retaining rail at the front of said tray shelf, a first upturned end retaining rail at the first end of said tray shelf and a second upturned end retaining rail at the second end of said tray shelf, with said back retaining wall being taller than said retaining rails and an integral hanger member;

wherein said hanger member engages with a lip trough of one of said tray support panels to support the tray on the support panel, and wherein said one or more trays may be repositioned vertically and slid horizontally on said lip troughs of said tray support panel;

whereby the facility may be erected with a wide variety of spaces within existing buildings since, because the enclosure is assemblable from within the enclosure, the storage and dispensing facility is erectable from within a space that is already enclosed on as many as three sides by preexisting walls.

23. A prefabricated product storage and dispensing facility as defined in claim 22, wherein said predetermined tray length is approximately 16 inches.

24. A prefabricated product storage and dispensing facility as defined in claim 22, wherein said facility further has at least one outer wall comprising at least one of said tray support panels, such that one or more of said trays may be mounted on the exterior of said facility.

25. A prefabricated product storage and dispensing facility as defined in claim 24, wherein said facility has an interior, and said outer wall has a surface facing said interior comprising at least one of said tray support panels.

26. A prefabricated product storage and dispensing facility as defined in claim 22, wherein said one or more trays each have a substantially flat bottom so that each of said trays may be removed from its respective display panel and set on a flat counter top.

27. A panel tray display system for improving storage capabilities of products, such as pharmaceutical products, beyond that of standard shelving in which shelves span continuously between end wall supports, the display system comprising:

a plurality of thin metal trays having a substantially flat bottom and a modular length of approximately 16 inches;

each tray comprising a hanger member, a back retaining wall, a tray shelf having a front, a first end and a second end, an upturned front retaining rail at the front of said tray shelf, a first upturned end retaining rail at the first end of said tray shelf and a second upturned end retaining rail at the second end of said tray shelf;

said tray shelf extending from said back retaining wall at an angle of less than 90 degrees from said back retaining wall; and at least one tray support panel having a plurality of vertically spaced lip troughs that are vertically spaced at regular intervals, each lip trough extending substantially continuously across said panel;

said trays being generally arranged in columns on said display, the vertical position of each tray being independent of the vertical position of a corresponding tray in an adjacent column;

wherein each hanger member is engaged in at least one of said lip troughs such that said support panel supports said trays, with said trays being easily removable from said lip troughs, wherein said trays are vertically repositionable and horizontally slidable on said tray support panel to minimize empty space on the display system, and wherein the tray shelves, extending at less than a 90 degree angle from the back retaining walls, angle upwardly slightly so as to prevent products that are stored on the trays from sliding forward on the trays.

* * * * *